United States Patent [19]

Kullander

[11] 4,296,982

[45] Oct. 27, 1981

[54] KNOCK-DOWN CABINET ASSEMBLY

[75] Inventor: Jan O. Kullander, Säffle, Sweden

[73] Assignee: Aktiebolaget Electrolux, Stockholm, Sweden

[21] Appl. No.: 94,346

[22] Filed: Nov. 14, 1979

[30] Foreign Application Priority Data

Apr. 9, 1979 [SE] Sweden ..... 7903120

[51] Int. Cl.[3] ..... A47B 43/00; A47F 5/00

[52] U.S. Cl. ..... 312/257 R; 312/257 SK; 312/257 A; 312/263; 211/135

[58] Field of Search ..... 312/257 R, 257 SK, 257 SM, 312/257 A, 263; 211/135

[56] References Cited

U.S. PATENT DOCUMENTS

| | | | |
|---|---|---|---|
| 455,280 | 6/1891 | Emerson | 312/257 R |
| 459,697 | 9/1891 | Atkinson | 312/257 R |
| 1,068,676 | 7/1913 | Lipsich | 312/263 |
| 1,806,610 | 5/1931 | Christensen | 312/263 |
| 1,821,668 | 9/1931 | Ross | 312/257 R |
| 2,188,602 | 1/1940 | Hall | 211/135 |
| 2,332,299 | 10/1943 | Cohn | 312/257 R |
| 2,522,097 | 9/1950 | Cookson | 211/183 |
| 3,623,784 | 11/1971 | Neufeld | 312/263 |
| 4,077,686 | 3/1978 | Bukaitz | 312/257 R |
| 4,173,379 | 11/1979 | Van Der Heiden et al. | 312/257 SM |

FOREIGN PATENT DOCUMENTS

| | | | |
|---|---|---|---|
| 643261 | 6/1962 | Canada | 211/135 |
| 2386965 | 8/1977 | France | 312/263 |
| 630417 | 10/1949 | United Kingdom | 312/257 R |
| 1048108 | 11/1966 | United Kingdom | 312/263 |
| 1162774 | 8/1969 | United Kingdom | 312/263 |

*Primary Examiner*—Victor N. Sakran
*Attorney, Agent, or Firm*—Alfred E. Miller

[57] ABSTRACT

A cabinet having a rear wall, two side walls and a frame-shaped front wall to form a box-like structure. All the walls are interconnected by means of special shaping of the adjacent edge portions in order to assemble the cabinet without the use of fastening means, but in a manner to prevent separation of said walls. The cabinet is provided with a top surface which can be readily mounted on the box-like structure without the aid of fastening devices, and also functions as a work surface. The addition of the top part to the cabinet further stabilizes the box-like structure.

5 Claims, 8 Drawing Figures

Fig. 2.
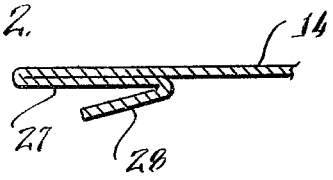
Fig. 3.
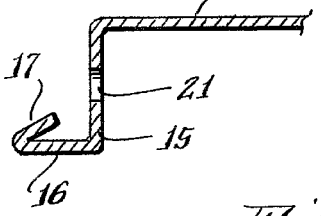
Fig. 4.
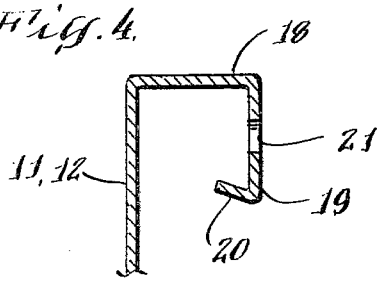
Fig. 5.
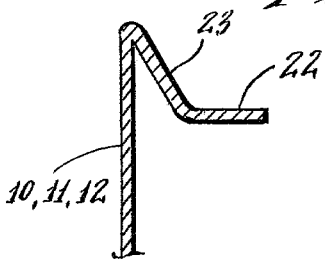
Fig. 6.
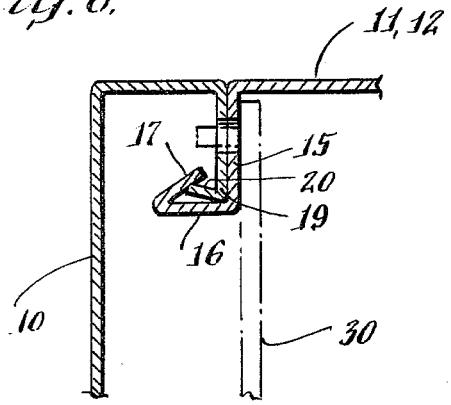
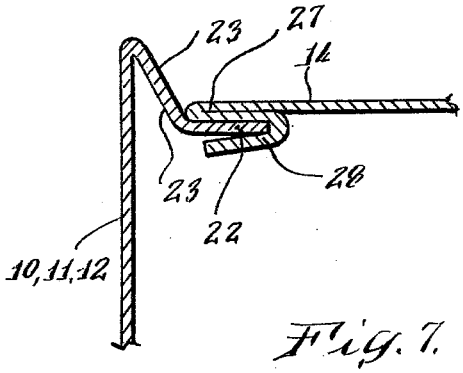
Fig. 7.
Fig. 8.
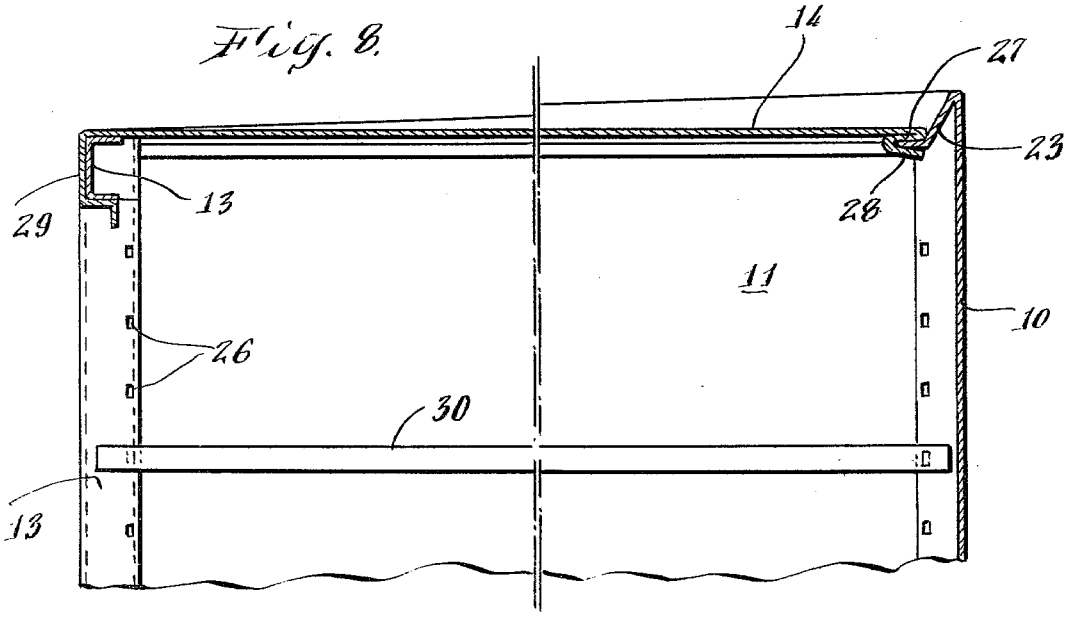

KNOCK-DOWN CABINET ASSEMBLY

The present invention relates to a cabinet, for example fabricated of sheet metal having a rear wall and two side walls. Adjacent edges of said rear wall and side walls are provided with bent portions which snap into and interconnect with each other upon turning or pivoting to thereby join the rear wall and side walls in such a manner that separation of the interconnected walls are prevented. A frame-shaped front wall part is interconnected to the other side edges of the side walls to form a box-like structure.

The object of the present invention is to provide a cabinet, as described thereinabove, which has a top surface that can be readily mounted without the aid of fastening devices to the aforesaid box-like structure, and functions as a work surface. The addition of said top part to the cabinet contributes further to the stability of said cabinet.

In order that the invention will be more clearly understood, it will now be disclosed in greater detail with reference to the accompanying drawings, in which:

FIG. 2 is a sectional view taken along the lines 2—2 of FIG. 1;

FIG. 3 is a sectional view taken along the lines 3—3 of FIG. 1;

FIG. 4 is a sectional view taken along the lines 4—4 of FIG. 1;

FIG. 5 is a sectional view taken along the lines 5—5 of FIG. 1;

FIG. 6 is a section through the side walls and rear wall when said cabinet is assembled;

FIG. 7 is a section through the top and a side wall upon assembling, showing the work surface part in actual position; and FIG. 8 is a sectional view showing the top in an assembled position.

DESCRIPTION OF THE PREFERRED EMBODIMENT

Figure 1:
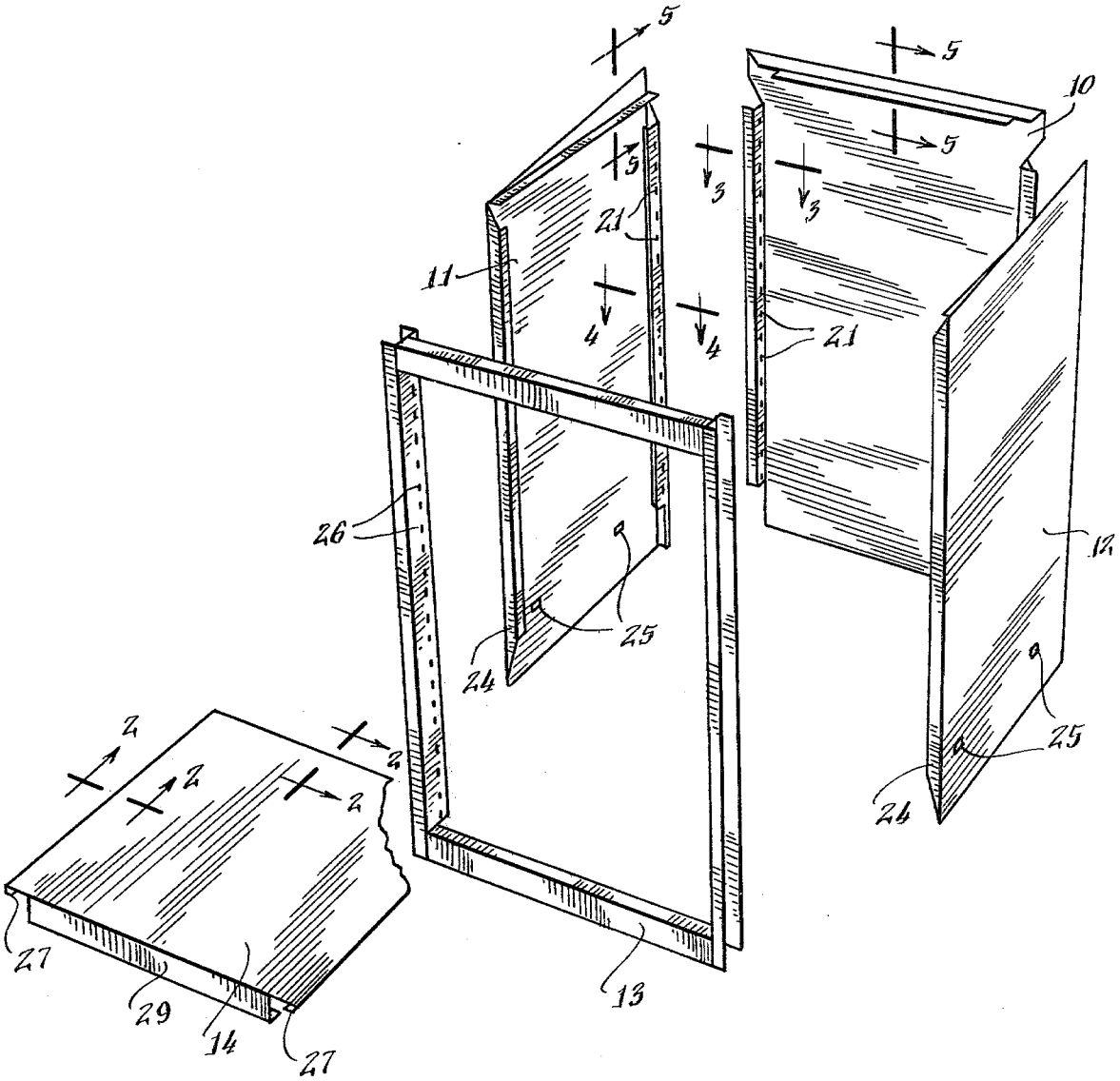
FIG. 1 is an exploded view of the parts of the cabinet with the front door removed for ease of illustration, said construction showing the principles of the present invention.

As seen in the drawings, the cabinet comprises a rear wall 10, two side walls 11 and 12, and a frame-shaped front wall 13, all of which can be snapped together and interconnected to form a stable box-like cabinet structure. The cabinet further illustrates a top part 14 which may be slid on top of the other sections 10, 11, 12 and 13 and interconnected therewith to form a stable top work surface. The cabinet is also provided with a bottom part (not shown) and several shelves (not shown) which can be hooked into spaced holes 26 in the front of the cabinet, as well as into apertures 21 on the rear and side walls of the cabinet. It should be noted that the rear wall 10 is symmetrical with respect to a vertical central line, and has vertical edges 15, as shown in FIG. 3, extending at an angle of approximately 90° to the vertical plane of the wall in a direction toward the interior of the cabinet. The edges 15 are provided with outer portions 16 which are bent through 90° in an opposite direction to the aforementioned edges. Each end of the portions has a part 17 with a reverse bend.

Referring to FIG. 4, it should be noted that each side wall 11 and 12 has a rear portion 18 located at an angle of 90° to the plane of the side wall and intended, when assembled, to form a continuation of the rear wall 10. Furthermore, the portion 18 has a part 19 that is again bent through 90°, and this part is bent in the same direction as the corresponding rear portion. The latter part terminates in a bent edge part 20. It should be observed that the angle between the bent edge and the bent part 19 is approximately 80°. The edge 20, when assembled, is intended to coact with the V-shaped groove formed between one bent part 17, and the respective outer portion 16 of the rear wall 10, as seen in FIG. 6.

Furthermore, as seen in FIG. 6, both edges 15 of the rear wall 10 and the bent parts 19 of the side walls 11 and 12 are provided with apertures 21 which are aligned when the parts are assembled, and whereby shelf supports are to be mounted. As seen in FIG. 7, the upper edge of the rear wall 10 is provided with a horizontal portion 22 which is bent from a part 23 projecting above the top part 14 forming a work surface. Furthermore, each side wall 11 and 12 has a portion corresponding to the horizontal portion and to the projecting part of the rear wall, but the projecting part of each side wall is triangular in configuration and its height increases from the front to the rear of the cabinet.

Referring now to FIG. 1, it should be observed that the vertical front edges 24 of the side walls 11 and 12 are generally U-shaped to enclose the slightly smaller vertical portions of the frame-shaped front wall 13. Furthermore, each side wall in its lower part is provided with struck out portions or lugs 25 to support a bottom part (not shown).

The frame-shaped front wall 13 is constructed to support a door (not shown) of a cabinet has several apertures 26 spaced from each other for a series of horizontal shelves arranged vertically. Along the three edges of top part 14, a portion 27 is bent through 180° as seen in FIG. 2, and terminates by an oppositely directed bent portion 28 so that a groove is formed between the two bent portions. The front edge of the top part 14 has a bent U-shaped part 29 which is adapted to snap-over and enclose the upper horizontal part of the front wall 13 (FIG. 1).

The cabinet is assembled in the following manner: The rear wall 10 and the side walls 11 and 12 are abutted together so that the edges 20 will be inserted into the grooves between the bent portion 17 and the outer portion 16. Thereafter, the side walls are turned or rotated outwardly relative to the rear wall, and will thus secure the walls relative to one another.

Thereafter, the front wall 13 in the form of a frame has its vertical sides inserted over the vertical front edges 24 of the side walls 11 and 12, respectively, said front wall 13 is further secured relative to the other parts of the cabinet by means of shelf supports 30, as shown in FIG. 6. Thus, the shelf supports also secure the side walls and the rear wall against vertical displacement.

The top part 14 is then inserted over the front wall, side walls and rear wall of the cabinet and this is accomplished by pushing said top from the front over the horizontal portions 22 of the side walls 11 and 12, as well as the rear wall 10, and the bent U-shaped portion 29 at the front of the top part is finally inserted over the upper part of the front wall 13 to enclose the same. Thereafter, the bottom part and shelves, if any, can be mounted in the cabinet. In addition, a hinged door, not shown, may be inserted in the front wall 13 of the cabinet to enclose the entire structure.

The present invention shows one embodiment, however it should be recognized that other modifications of the present invention can be made within the scope of the following claims.

What is claimed is:

1. A cabinet having a top work surface comprising: a rear wall and two side walls, the adjacent edges of said rear and side walls having bent portions which upon abutment and pivoting hook one another to form a joint which prevents separatiion of said side walls and rear wall, a frame-shaped front wall having vertical posts adapted to snap over to join said front wall to said side walls to thereby form a box-like structure, the upper portions of both of said side walls and rear wall having inwardly directed horizontal portions, a top part having three edges bent back on itself in a reverse direction and terminating in an oppositely directed bent portion forming outwardly directed grooves between said bent back portion and said oppositely directed bent part, said grooves being adapted to engage with said inwardly directed horizontal portions, and wherein said top part is a flat plate forming a work surface, said upper parts of said side walls each being provided with a horizontal portion upon which the grooves of said top part are slid, and an additional part above said horizontal portion in the form of a triangular surface which forms an edge portion projecting above the top surface of said top part, and whose height increases in a direction toward the rear wall of said cabinet.

2. A cabinet as claimed in claim 1 wherein said top part has a fourth edge which is bent to snap around the top of said frame-shaped front wall when said top part is in position on said cabinet.

3. A cabinet as set forth in claim 1 wherein said top part is provided with a portion that is bent through approximately 180° relative to the flat surface of said top part, and an additional terminal portion that is bent in the opposite direction to said portion to thereby form a groove therebetween.

4. A cabinet as set forth in claim 1 in which said triangular surface is formed by the edge portions of said side wall, said portions being bent more than 90°, and another part which is bent less than 90° in another direction to form said horizontal portion.

5. A cabinet as claimed in claim 1 wherein said rear wall has a part projecting above said horizontal portion, and associating with said edge portion of said side wall.

* * * * *